US005918704A

United States Patent [19]

Chevilliard et al.

[11] Patent Number: 5,918,704

[45] Date of Patent: Jul. 6, 1999

[54] CAR DOOR LOCK

[75] Inventors: Marc Frederic Chevilliard; Stephen Roberts; Gregory Milton O'Seep; Frederic Bruno Delmas, all of Penang, Malaysia; Lap Yick Lee, Luk Yeung Sun Chuen, The Hong Kong Special Administrative Region of the People's Republic of China

[73] Assignee: Otis Elevator Company, Farmington, Conn.

[21] Appl. No.: 08/672,680

[22] Filed: Jun. 28, 1996

[51] Int. Cl.[6] ..... B66B 13/06

[52] U.S. Cl. ..... 187/335

[58] Field of Search ..... 187/335, 331

[56] References Cited

U.S. PATENT DOCUMENTS

| | | | |
|---|---|---|---|
| 1,573,345 | 2/1926 | Kalte | 187/335 |
| 5,377,785 | 1/1995 | Pearson | 187/335 |
| 5,386,886 | 2/1995 | Kobayashi et al. | 187/335 |
| 5,454,447 | 10/1995 | Kulak et al. | 187/331 |
| 5,690,189 | 11/1997 | Karner | 187/335 |
| 5,730,254 | 3/1998 | Nguyen | 187/335 |

FOREIGN PATENT DOCUMENTS

| | | |
|---|---|---|
| 0035979A1 | 9/1981 | European Pat. Off. . |
| 0130493A2 | 1/1985 | European Pat. Off. . |
| 2212548 | 7/1989 | United Kingdom . |
| WO 8001186A1 | 6/1980 | WIPO . |

OTHER PUBLICATIONS

U.K. Search Report dated Sep. 12, 1997; Serial No. GB 9713687.3.

*Primary Examiner*—William E. Terrell
*Assistant Examiner*—Khoi H. Tran

[57] ABSTRACT

A car door lock for locking elevator car doors when the elevator car is in transit and/or outside the door zone includes a solenoid activated lever that pushes a lock arm to open. The solenoid is activated in two phases to reduce associated noise. The car door lock includes an operator switch which signals the door controller that the door lock is opened and the elevator car door is free to be opened. The car door also includes a safety switch which signals the door controller that the elevator car door lock is closed.

11 Claims, 2 Drawing Sheets

CAR DOOR LOCK

TECHNICAL FIELD

The present invention relates to elevator systems and, more particularly, to elevator car door locks therefor.

BACKGROUND OF THE INVENTION

It is typical for elevator systems to include a door lock mechanism on hoistway doors. The door lock mechanisms on the hoistway doors prevent the hoistway doors from being opened when the elevator car is not at the landing. Majority of the hoistway door locking mechanisms are mechanical and include multiple rollers and moving parts. Such door locking mechanisms require frequent adjustments and are a cause for many callbacks.

In recent years, some countries have begun to require locking devices for elevator car doors. For example, Hong Kong requires that the elevator car doors be locked while the elevator car is in transit and is outside of the door zone. The requirement also specifies that the door be closed and opened mechanically in response to an electrical signal. One major concern in door locking mechanisms, besides reliability and adjustability problems, is the noise level. The noise is especially a concern for the elevator car since the door locking mechanism should not be noticeable to the occupants of the elevator car.

DISCLOSURE OF THE INVENTION

It is an object of the present invention to provide an effective door lock mechanism for elevator doors.

It is another object of the present invention to minimize noise generated by the door lock.

According to the present invention, a door lock includes a lock box secured to an elevator car and a lock arm secured to an elevator car door. The lock box includes a solenoid which activates a lever to disengage the lock arm. The solenoid is activated in two phases to reduce the noise. During the first phase of solenoid actuation, a damper limits movement of the lock arm and of the solenoid plunger. During the second phase of the solenoid actuation, a lever bumper prevents the solenoid plunger from completely closing.

The door lock also includes a safety switch and an operator switch which send signals to the door controller that the elevator car door lock is either closed or opened, respectively.

One advantage of the present invention is that the door lock can be installed on an elevator system with any type of the controller or door system. Also, in the event of total power loss, a battery back-up power supply would release the car door lock and allow passengers to exit the elevator car.

The foregoing and other advantages of the present invention become more apparent in light of the following detailed description of the exemplary embodiments thereof, as illustrated in the accompanying drawings.

BEST MODE FOR CARRYING OUT THE INVENTION

Figure 1:
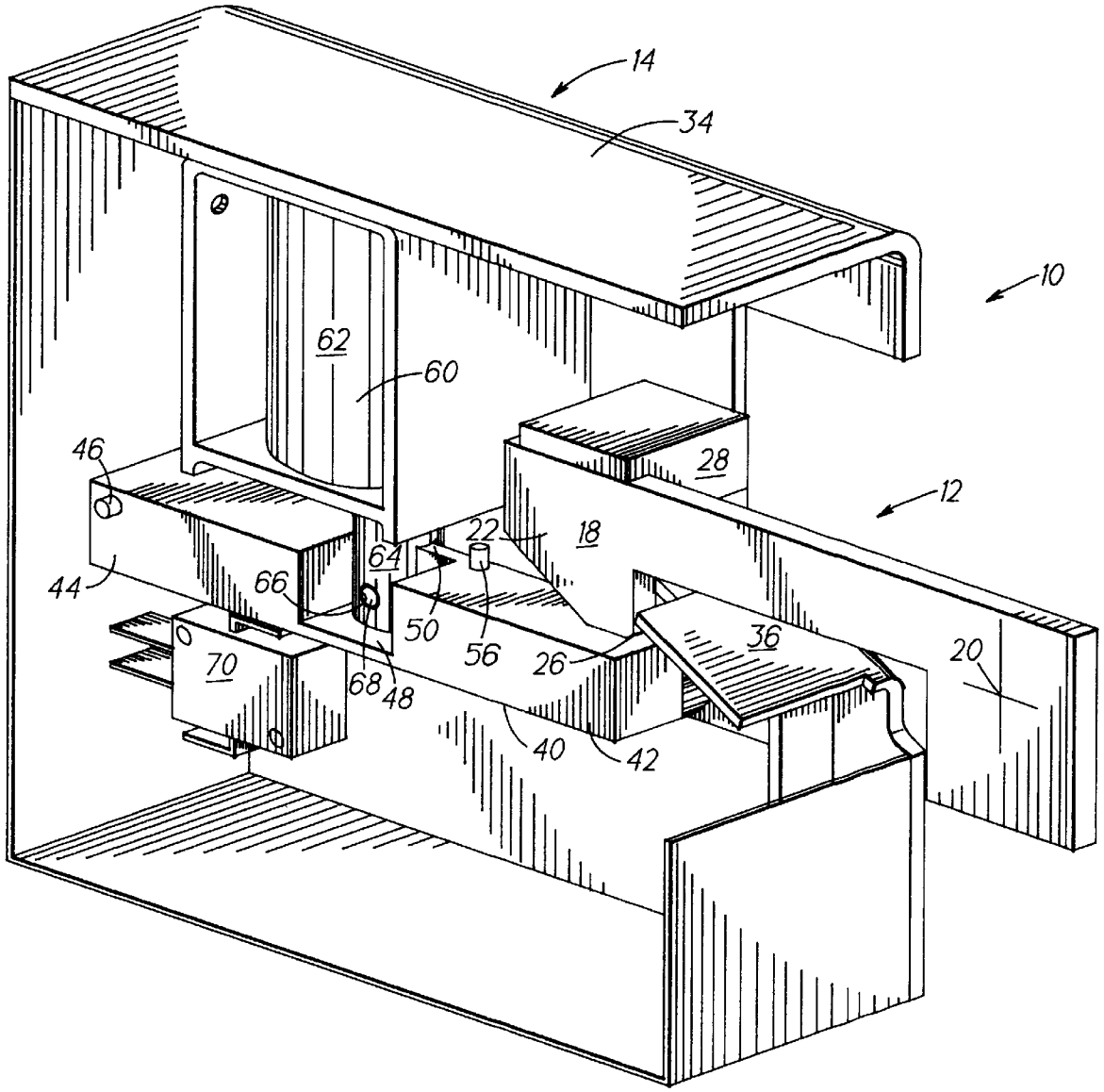
FIG. 1 is a schematic, perspective view of the elevator door lock.
Figure 2:
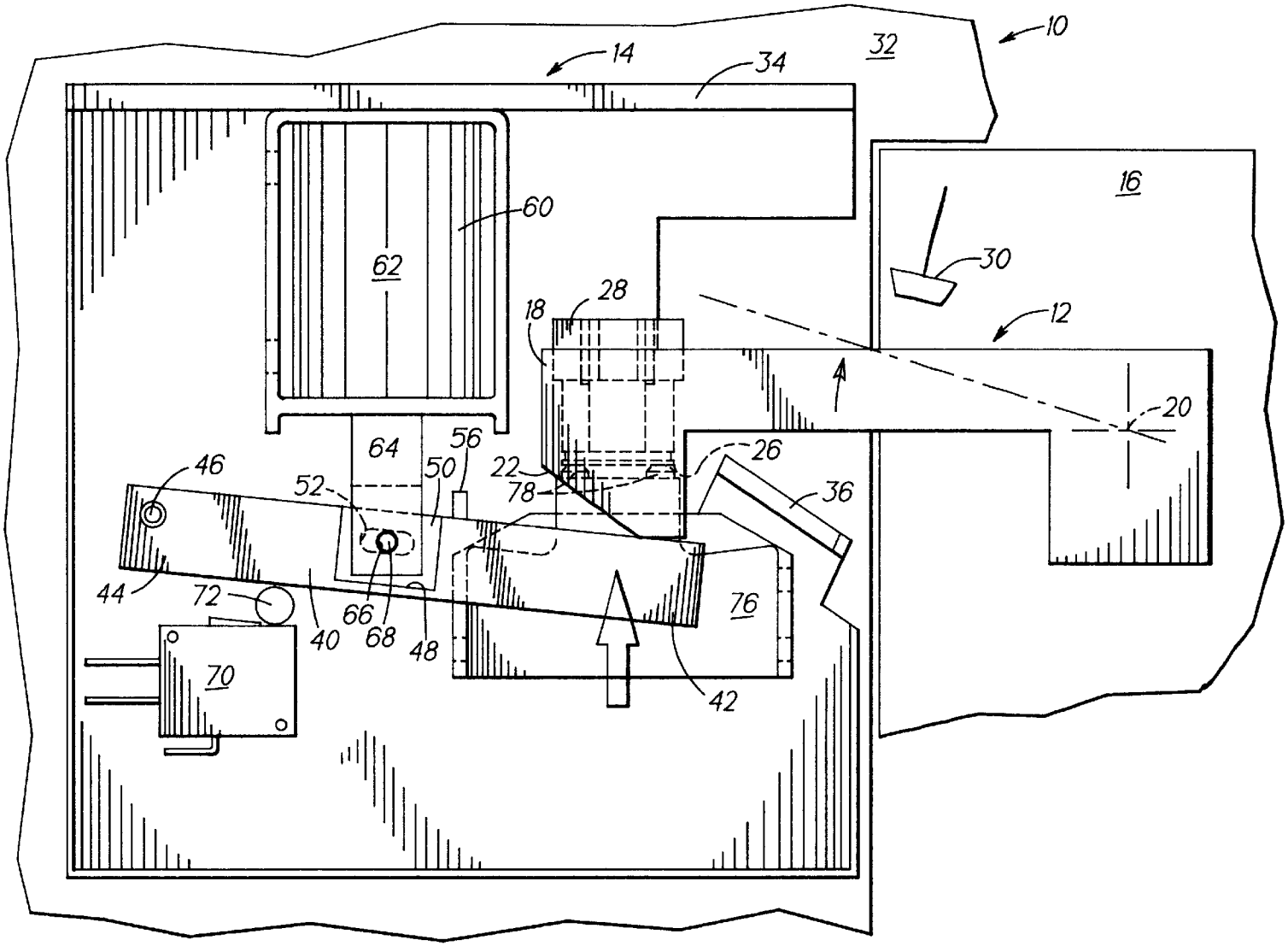
FIG. 2 is a schematic side elevation of the elevator door lock of FIG. 1.

Referring to FIG. 1, an elevator car door lock 10 includes a lock arm 12 and a lock box 14. The lock arm 12 is pivotably secured onto an elevator car door 16, as shown in FIG. 2, and includes a hook portion 18 on one end and an arm pivot 20 on the other end. The hook portion 18 has an angled surface 22 and a bottom with a shunt plate 26 attached thereto. A weight 28 is secured to the hook portion 18 of the lock arm 12. A damper 30, shown in FIG. 2, is disposed on the elevator car door 16 upward from the lock arm 12.

The lock box 14 is attached to the elevator car 32 and comprises a housing 34 with an inclined tab 36 protruding therefrom. The incline of the tab 36 substantially corresponds to the angle of the angled surface 22 of the hook portion 18 of the lock arm 12. A lever 40 has an open or free end 42 an a pivoted end 44 with the pivoted end 44 pivotably attaching onto the housing 34 via a lever pivot 46. The lever 40 includes a notch 48 and a web 50 with an elliptical opening 52 formed within the web 50. A nylon bumper 56 is fixedly attached to the upper surface of the lever 40.

A solenoid 60 includes a solenoid coil frame 62 and a plunger 64 and is fixedly attached onto the housing 34. One end of the plunger fits into the solenoid frame and the other end of the plunger fits into the notch 48 of the lever 40. The open end of the plunger includes a round opening 66 that is in register with the elliptical opening 52 of the lever 40. A spring pin 68 fits into the round opening and the elliptical opening to couple the plunger and the lever together but still to allow relative motion therebetween. The solenoid 60 has an activated mode and a deactivated mode. FIG. 1 depicts the solenoid in the deactivated mode wherein the plunger 64 is in the down position. In the activated mode, the plunger 64 moves upwards.

An operator switch 70 is disposed downward from the lever 40. The switch 70 has a contact 72 protruding therefrom so that when the lever 40 is in the open position, the pivot end 44 of the lever 40 comes out of contact with the contact 72 of the operator switch 70. The operator switch 70 is wired to the door controller (not shown).

A safety switch is fixedly attached to the housing 34 downward from the hook portion of the lock arm. The safety switch 76 includes shunt contacts 78, as shown in FIG. 2.

In operation, the elevator cab door lock 10 is in a closed position, as shown in FIGS. 1 and 2, while the elevator cab is outside the door zone and the cab doors are closed. In the closed position the hook portion 18 of the lock arm 12 is hooked behind the tab 36 with the shunt plate 26 making contact with the shunt contacts 78. The solenoid 60 in the closed position of the door lock 10 is deactivated. The coil frame 62 of the solenoid 60 is deenergized and the plunger 64 is released downward. The lever 40 attached to the plunger 64 is also in the down position with the contacts 72 of the operator switch 70 being in contact with the lever 40.

When the door controller (not shown) sends a signal to the solenoid 60 to open the door 16, the solenoid gets activated and lifts the plunger 64 upward. The plunger 64 attached to the lever 40 lifts the lever upward to pivot about the lever pivot 46. As the lever 40 pivots upwards, the open end 42 of the lever 40 moves the hook 18 of the lock arm 12 upwards to clear the tab 36. The lock arm 12 pivots about the arm pivot 20 upwards breaking the contact between the shunt plate 26 disposed on the lock arm 18 and the shunt contacts 78. The initial rise of the plunger 64 of the solenoid 60 is slowed when the movement of the lock arm 12 is limited by the damper 30 as shown in FIG. 2. The position of the damper 30 is chosen so that at approximately seventy percent (70%) of the plunger rise, the lock arm 12 hits against the damper 30 to slow the plunger rise and thereby reduces the impact noise generated by the solenoid 60. This prevents the solenoid from slamming closed. The solenoid 60 continues to actuate and continues to raise the open end of the lever 40. The lever, in turn, continues to push the hook 18 of the lock arm 12 upwards until the hook of the lock arm clears the tab 36. As the solenoid 60 continues to activate during the second phase of the rise for approximately the remaining thirty percent (30%) of the entire plunger rise, the damper 30 is compressed to allow complete opening of the lock. The lever bumper 56 stops the solenoid 60 from fully closing. As the hook 18 of the lock arm 12 clears the tab 36, the operator switch 70 contact is broken between the lever 40 and the contacts 72. The operator switch 70 signals the door controller that mechanical lock 10 is free and the door 16 is safe to open. The door 16 then moves to the open position. Once the doors are opened, the solenoid 60 gets deactivated and the plunger 64 drops downward pushing the lever 40 in the down position.

To close the elevator car doors 16, the angled surface 22 of the lock arm 12 slides upwards on the inclined surface of the tab 36 until the hook 18, weighed down by the weight 28, drops behind the tab 36, thereby locking the doors shut. As the lock arm 12 drops down, the shunt plate 26 of the lock arm and shunt contacts 78 make contact and the safety switch 76 signals the door controller that the door lock 10 is closed.

The door lock 10 of the present invention prevents anyone from opening the elevator car doors while the elevator car is moving and/or is outside of the door zone. The door lock also sends two signals to the door controller. One signal is sent by the operator switch 70 when the lock arm of the door lock clears the tab of the lock box and the door is free to open. Another signal is sent by the safety switch 76 when the door lock is closed and the elevator car can move within the hoistway.

One advantage of the present invention is that the solenoid 60 is actuated in two phases to reduce the associated noise. The first phase of actuation is stopped by the damper 30. This prevents the solenoid 60 from slamming closed. The second phase of actuation is stopped by the lever bumper 56 and prevents the solenoid from fully closing. Neither impact generates much noise. The first impact between the damper 30 and the lock arm 12 achieves low noise contact because the damper 30 is fabricated from rubber. The second impact between the lever bumper 56 and the solenoid frame 62 is also a low noise contact because the lever bumper 56 is fabricated from a nylon material. Also, the clearance between the lever 40 and the lock arm 12 in the closed position is minimized to avoid noise generated by the lever 40 striking the lock arm. The distance cannot be reduced to zero because noise would be generated from the lock arm dropping down into the lock box and hitting against the lever. Another noise reducing feature that can be added is a shield (not shown) fabricated from either nylon or plastic covering the tab 36 to reduce any noise generated by contact between the metal hook 18 of the lock arm 12 and the metal tab 36. The door lock also includes a transparent plastic cover (not shown) that reduces noise and at the same time allows visual inspection of the door lock mechanism.

Another advantage of the present invention is that the door lock can be installed on an elevator system with any type of the controller or door system. Also, in the event of total power loss, a battery back-up power supply would release the car door lock and allow passengers to exit the elevator car.

Although the present invention is described for use on the elevator car doors, the door locks of the present invention can be used for locking the hoistway door in either an elevator system or any other transport system.

While the present invention has been illustrated and described with respect to a particular embodiment thereof, it should be appreciated by those of ordinary skill in the art, that various modifications to this invention may be made without departing from the spirit and scope of the present invention.

We claim:

1. A door lock for locking elevator doors of an elevator car when said elevator car is outside of a door zone, said door lock comprising:

a housing fixedly attached onto said elevator car, said housing having an inclined tab;

a solenoid fixedly mounted within said housing, said solenoid having an activated and a deactivated mode, said solenoid having a solenoid coil frame and a plunger, in said activated mode said solenoid having said plunger pulled upward into said coil frame, in said deactivated mode said solenoid having plunger released downward from said coil frame, said plunger being movably attached to a lever;

a lock arm pivotably attached onto said elevator car door, said lock arm having a closed and an opened position, in said closed position said lock arm being engaged by said inclined tab, in said opened position said lock arm clearing said tab and allowing said elevator door to be opened, said lever pushing and pushing said lock arm into said open position; and a damper disposed in the path of said lock arm and positioned thereabove to engage said lock arm as said plunger reaches approximately 70% of the entire plunger rise, said damper slowing the rise of said plunger during the remaining approximately 30% of the entire plunger rise.

2. The door lock according to claim 1 further comprising a bumper in the path of said lever preventing said solenoid from slamming closed.

3. The door lock according to claim 1 further comprising a safety switch to send a signal to a door controller that said lock arm is in closed position.

4. The door lock according to claim 1 further comprising an operator switch sending a signal to a door controller that said lock arm has cleared said inclined tab and said elevator door is free to open.

5. The door lock according to claim 1 wherein said inclined tab having a plastic cap to reduce noise.

6. The door lock according to claim 1 further characterized by a weight being fixedly attached onto said lock arm.

7. The door lock according to claim 1 further comprising a transparent cover fitting over said lock box.

8. A car door lock for locking elevator doors of an elevator car when said elevator car is outside of a door zone, said car door lock comprising:

a housing fixedly attached onto said elevator car, said housing having an inclined tab;

a lever having a free end and a pivoted end, said pivoted end being pivotably mounted within said housing by means of a lever pivot;

a solenoid fixedly mounted within said housing, said solenoid having an activated and a deactivated mode, said solenoid having a solenoid coil frame and a plunger, in said activated mode said solenoid having said plunger pulled upward into said coil frame, and in said deactivated mode said solenoid having said plunger released downward from said coil frame, said plunger being movably attached to said lever;

a lock arm pivotably attached onto said elevator car door, said lock arm having a closed position and an opened position, in said closed position said lock arm being engaged by said inclined tab, in said opened position said lock arm clearing said tab and allowing said elevator door to be opened, said lock arm being placed in said opened position by contact with the free end of said lever when said lever is rotated about said pivot as said plunger rises in said activated mode, said lock arm being in said closed position when said plunger is released in said deactivated mode; and a damper disposed in the path of said lock arm and positioned thereabove to engage said lock arm as said plunger reaches approximately 70% of the entire plunger rise, said damper slowing the rise of said plunger during the remaining approximately 30% of the entire plunger rise.

9. The door lock according to claim 8 further comprising a bumper disposed in the path of said lever preventing said solenoid from slamming closed.

10. The door lock according to claim 8 further comprising a safety switch to send a signal to a door controller that said lock arm is in closed position.

11. The door lock according to claim 8 further comprising an operator switch sending a signal to a door controller that said lock arm has cleared said inclined tab and said elevator door is free to open.

* * * * *